US006547417B2

(12) United States Patent
Lee

(10) Patent No.: US 6,547,417 B2
(45) Date of Patent: Apr. 15, 2003

(54) CONVENIENT REPLACEMENT COMPOSITE POWER-SAVING ENVIRONMENTAL ELECTRIC CLUB

(76) Inventor: Han-Ming Lee, P.O. Box 7-820, Taipei (TW)

( * ) Notice: Subject to any disclaimer, the term of this patent is extended or adjusted under 35 U.S.C. 154(b) by 0 days.

(21) Appl. No.: 09/864,483

(22) Filed: May 25, 2001

(65) Prior Publication Data

US 2002/0176253 A1 Nov. 28, 2002

(51) Int. Cl.[7] ..... F21V 21/00

(52) U.S. Cl. ..... 362/249; 362/184; 362/800; 315/57

(58) Field of Search ..... 362/249, 184, 362/185, 240, 254, 800; 315/56, 57, 70

(56) References Cited

U.S. PATENT DOCUMENTS 5,506,760 A * 4/1996 Giebler et al. ..... 362/249
5,726,535 A * 3/1998 Yan ..... 315/185 R
5,806,965 A * 9/1998 Deese ..... 362/226
5,921,660 A * 7/1999 Yu ..... 362/249
6,343,871 B1 * 2/2002 Yu ..... 362/250
6,357,902 B1 * 3/2002 Horowitz ..... 362/240
6,462,475 B1 * 10/2002 Lee ..... 315/57

* cited by examiner

*Primary Examiner*—Thomas M. Sember
*Assistant Examiner*—John Amarantides

(57) ABSTRACT

A convenient replacement composite power saving environmental bulb structure to replace the traditional bulb by diodes allowing easy replacement of the bulb and color change as desired adapting to the environment of the living space comprised of two semi-spherical casings, a caulking groove is provided inside of each semi-spherical casing to snap onto the keyboard and longitudinally arranged retaining rings are provided on external surface of each said semi-spherical casing and a matching hole is bored in each ring for fast insertion in position by the terminal plate sleeve plugged on the keyboard; a tapered channel track by both sides of the matching hole permits the terminal plate to easily slide into the keyboard so that both pins of the diode are directly connected to the sleeve of the terminal plate together with the keyboard, both semi-spherical casings and the voltage variation plate into an integrated assembly in parallel for giving excellent conduction.

2 Claims, 7 Drawing Sheets

CONVENIENT REPLACEMENT COMPOSITE POWER-SAVING ENVIRONMENTAL ELECTRIC CLUB

BACKGROUND OF THE INVENTION (a) Field of the Invention

The present invention relates to a convenient replacement composite power-saving environmental electric bulb, and more particularly to one that allows easy and safe configuration and color change as desired depending on the environment of the mounting location while giving multiple practical benefits including precise and consistent conductivity.

(b) Description of the Prior Art

It is indeed that bulb is the window to one's soul during the night. Either for domestic requirements, industrial application or electric appliances, bulb is a must. Particularly, bulbs used in lighting fixtures and table lights for domestic purpose are very popular. A bulb assembly generally available in the market is essentially comprised of a glass bulb containing a tungsten filament, which illuminates when electric current passes through it. Tungsten filament consumes a lot of power and gives a limited service life. The bulb when in use could easily rises to higher temperature due to the heat emitted from the bulb. Upon replacing the bulb in case of failure or circuit breakage, one could easily get burnt. Children are more vulnerable to get hurt by accidentally touching the bulb in use. Once it is disposed, the broken pieces present a serious environmental problem. Even a fluorescent bulb though consuming less power, its glass casing also creates environmental problem and prevents from easy replacement.

SUMMARY OF THE INVENTION

The primary purpose of the present invention is to provide a convenient replacement composite power saving environmental bulb essentially comprised of two semi-spherical casings, keyboard, terminal plate, voltage variation plate, light holder and light emission diode (LED) that allows convenient replacement composition, safety operation, color variation and precise and consistent conductivity.

The secondary purpose of the present invention is to provide a convenient replacement composite power saving environmental bulb, within, outer surface of each said semi-spherical casing is longitudinally arranged with multiple retaining rings in equal distance, a matching hole is bored within each ring for the terminal plate insertion sleeves on the keyboard to exactly align to the hole for fast insertion in position.

Another purpose yet of the present invention is to provide a convenient replacement composite power saving environmental bulb, within, tapered channel track is provided by the matching hole for both sides of the terminal plate to slide into position against the corresponding tapered surface.

Another purpose yet of the present invention is to provide a convenient replacement composite power saving environmental bulb, within, a prior art of bulb is replaced with only diode to warrant fast and safe replacement without being exposed to risks of getting burnt by the bulb and broken glass.

To achieve said purposes, the present invention is essentially comprised of two semi-spherical casings, a caulking groove is provided inside of each semi-spherical casing to snap onto the keyboard and longitudinally arranged retaining rings are provided on external surface of each said semi-spherical casing and a matching hole is bored in each ring for fast insertion in position by the terminal plate sleeve plugged on the keyboard. Furthermore, a tapered channel track by both sides of the matching hole permits the terminal plate to easily slide into the keyboard so that both pins of the diode are directly connected to the sleeve of the terminal plate together with the keyboard, both semi-spherical casings and the voltage variation plate into an integrated assembly in parallel for giving excellent conduction. Wherein, tapered track is used as a buffer to both sides of the terminal plate by eliminating the pressing force from the diode, so that the sleeve can be secured to hold both pins of the diode in position.

DETAILED DESCRIPTION OF THE PREFERRED EMBODIMENTS

Figure 1:
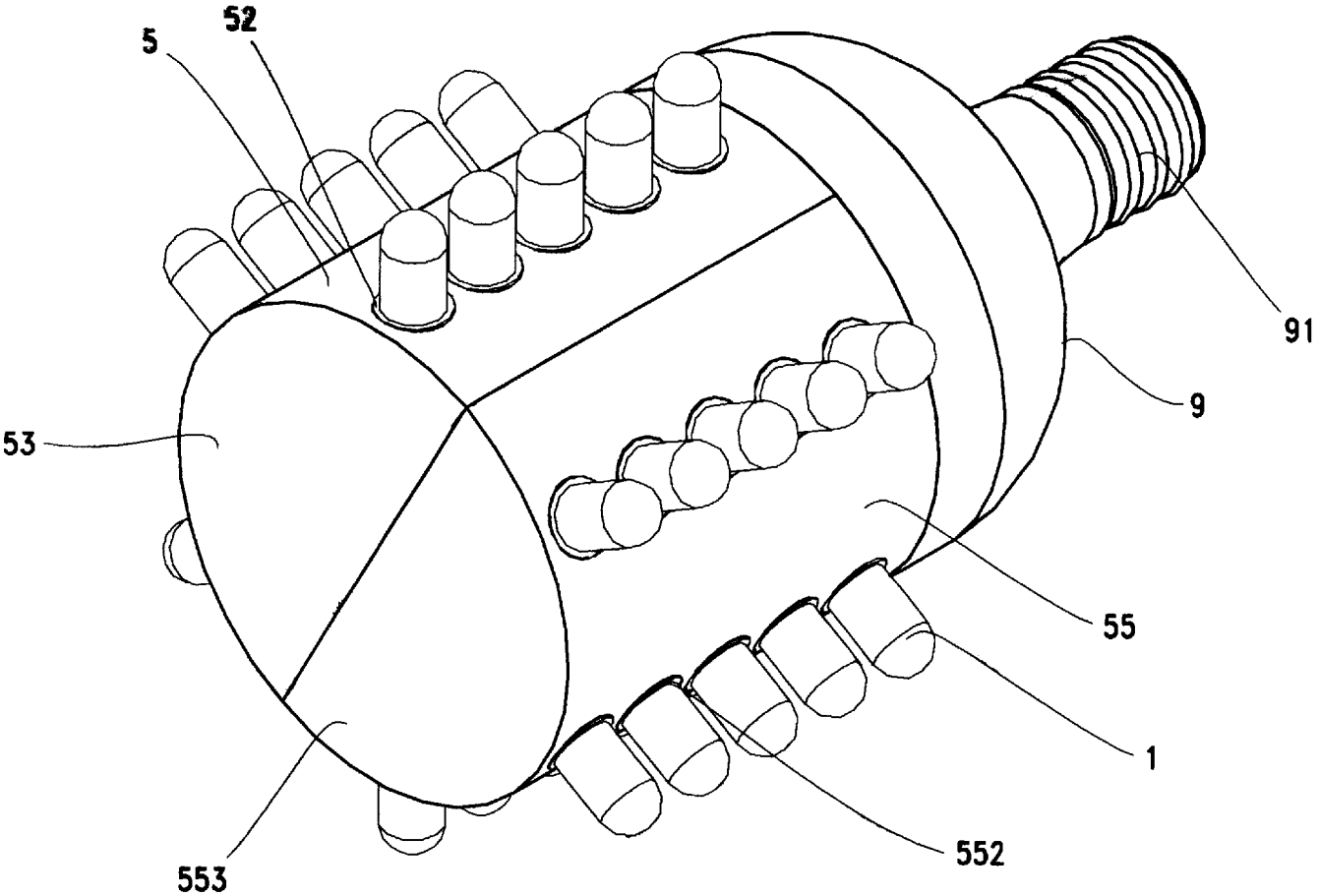
FIG. 1 is a schematic view of the structure of the present invention.
Figure 2:
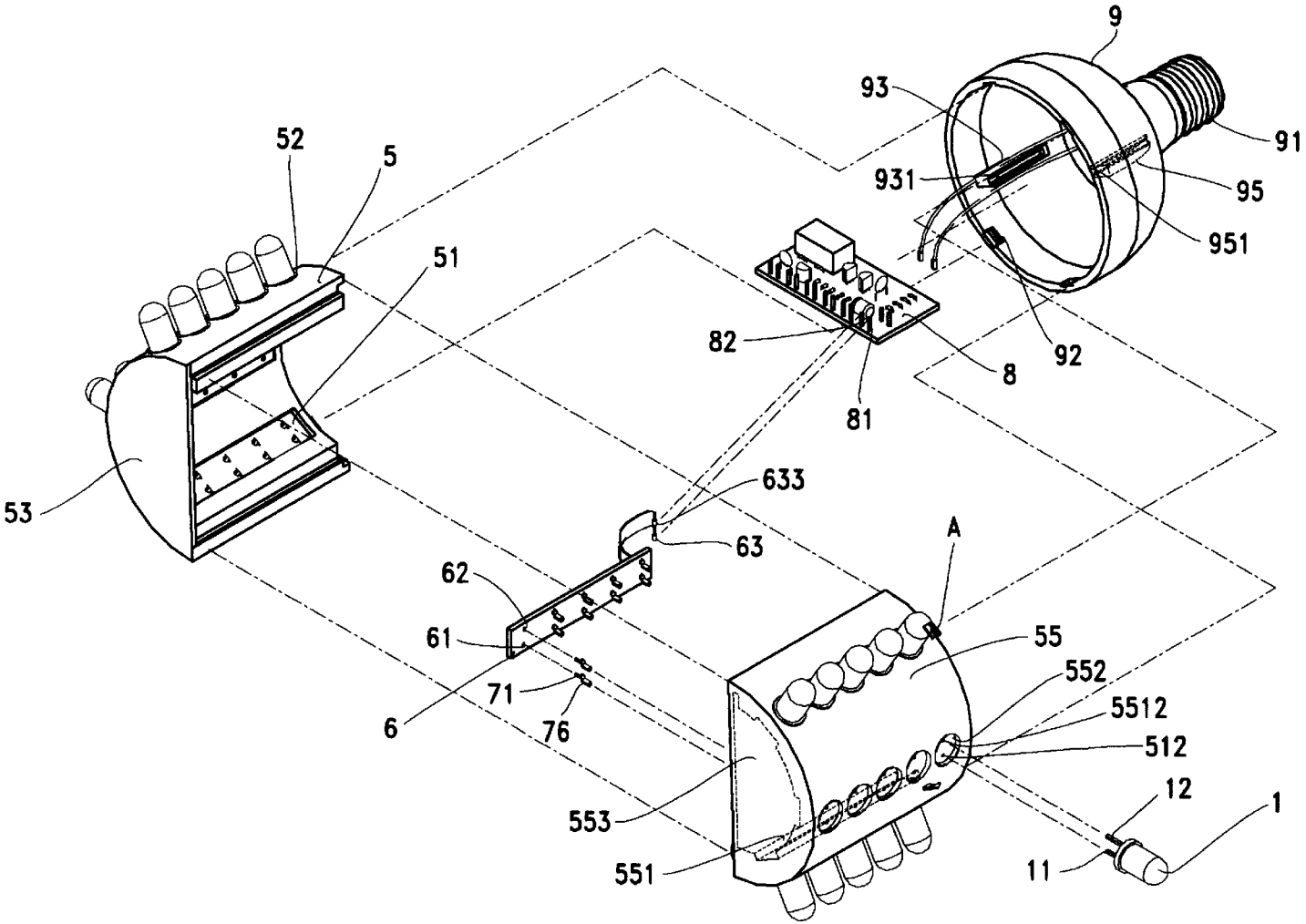
FIG. 2 is a schematic view showing components of the present invention.
Figure 3:
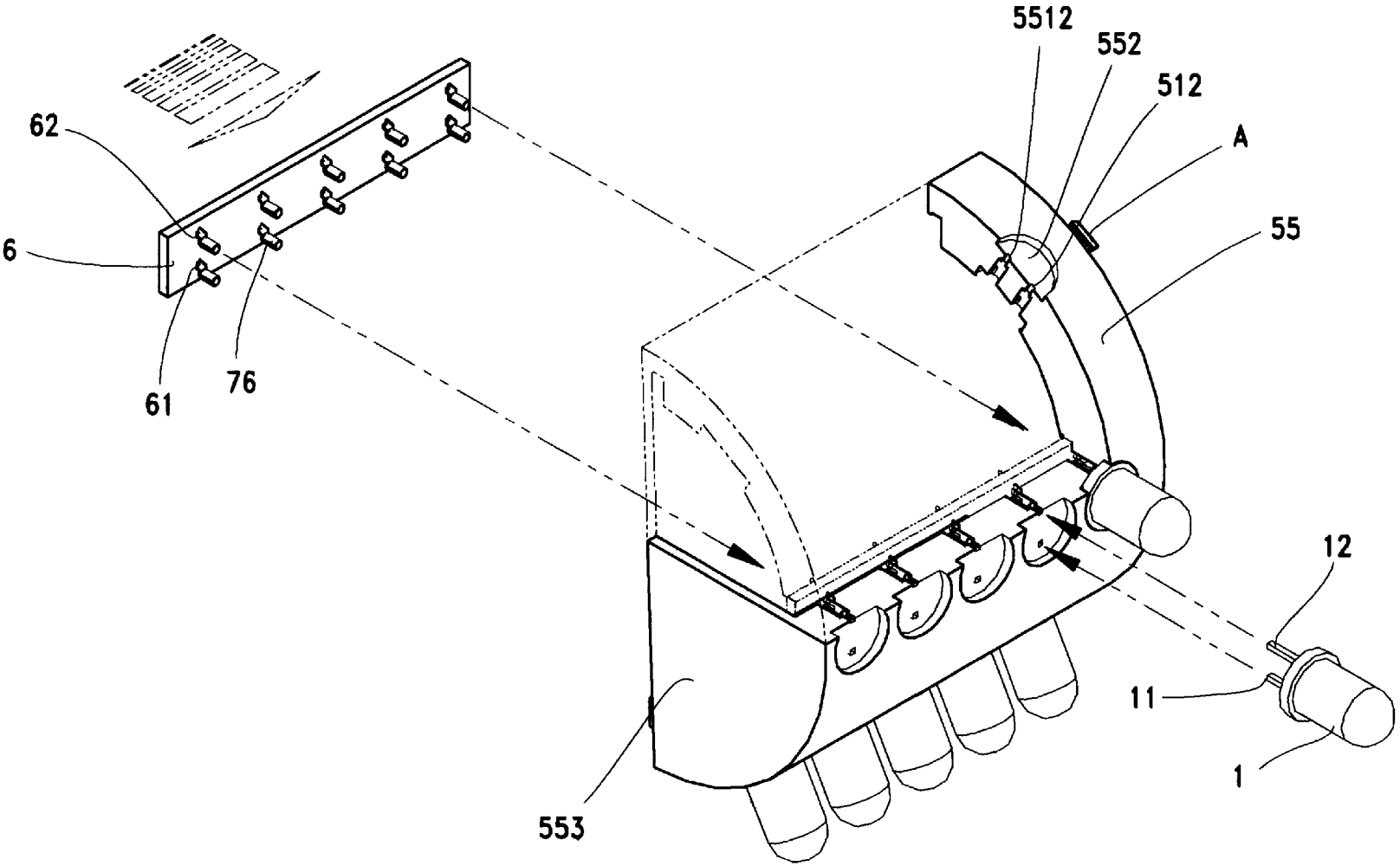
FIG. 3 is a view showing a preferred embodiment of the semi-spherical casings to house a terminal plate of the present invention.
Figure 4:
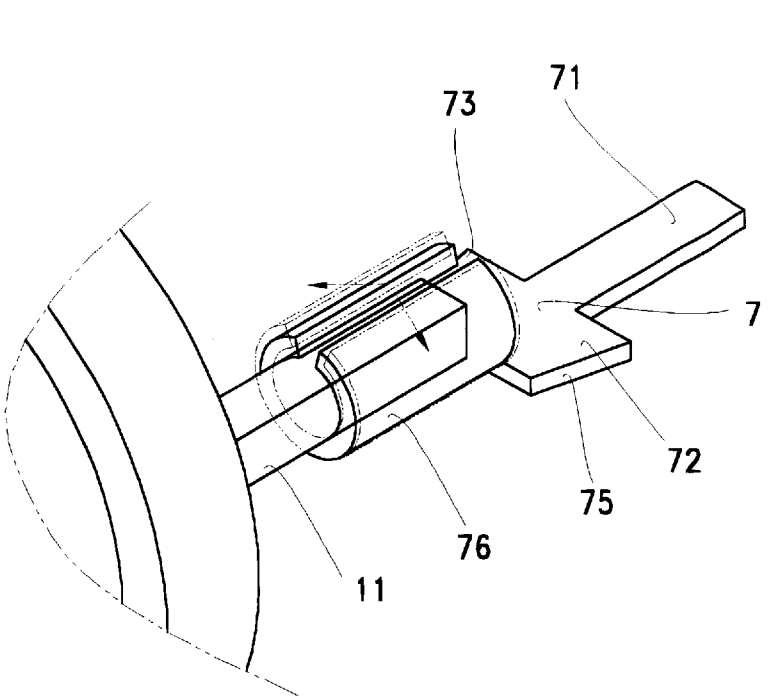
FIG. 4 is a schematic view showing a preferred embodiment of terminal plate sleeve and counter tapered plate of the present invention as assembled.
Figure 4:
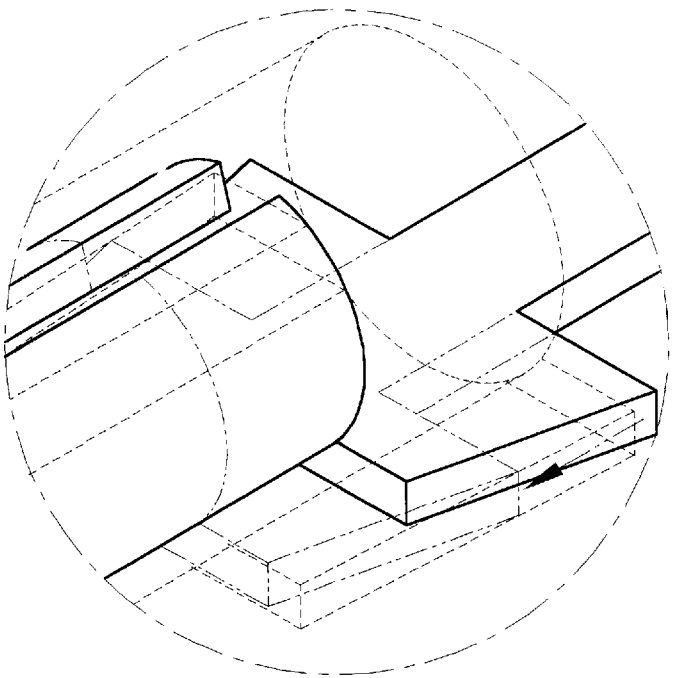
Figure 5:
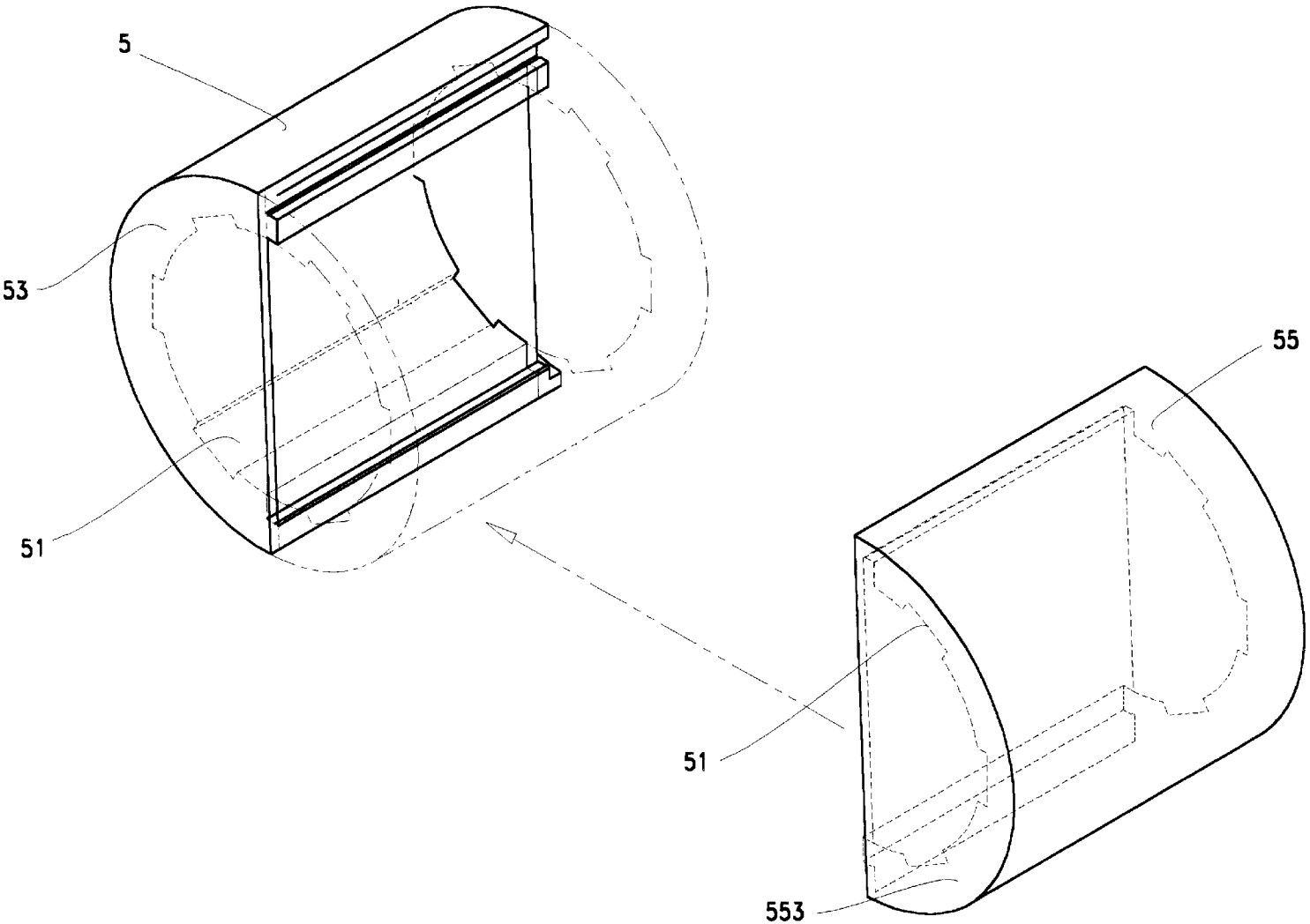
FIG. 5 is a view showing a preferred embodiment of both semi-spherical casings of the present invention as assembled.
Figure 6:
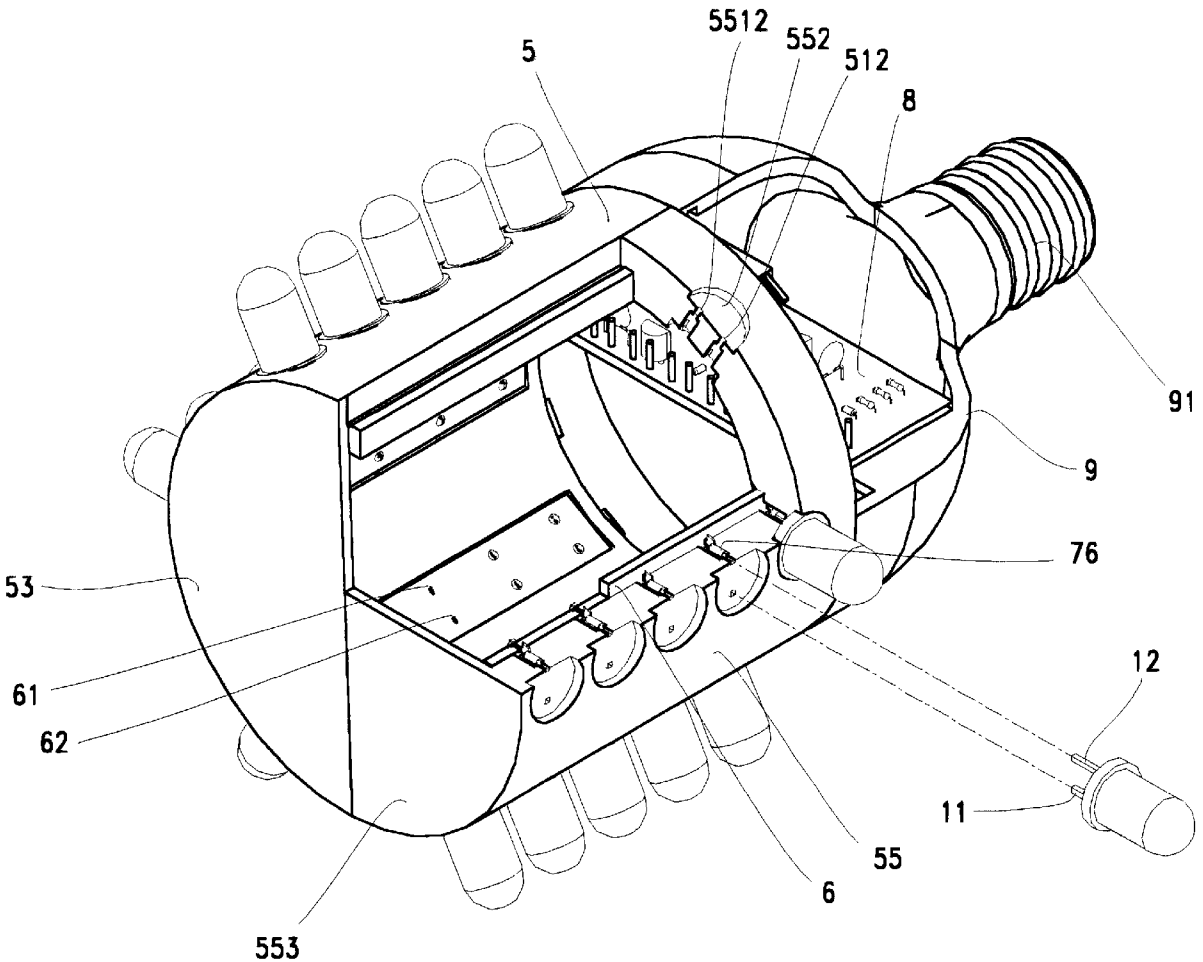
FIG. 6 is a sectional view showing the structure of the present invention.
Figure 7:
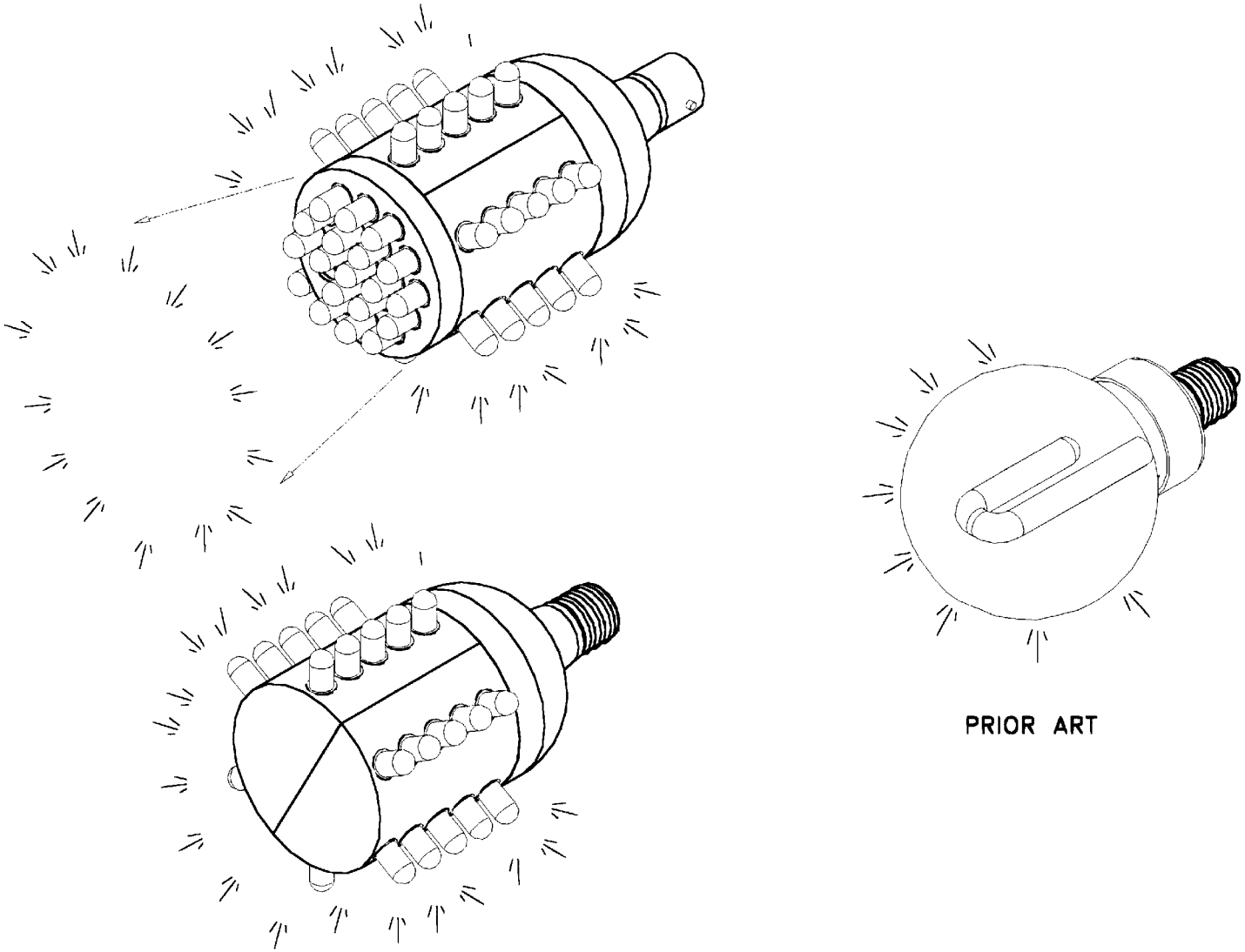
FIG. 7 is a view showing the structure of the present invention in contrast to that of the prior art.

Referring to FIGS. 1 through 7, a convenient replacement composite power saving environmental bulb of the present invention is comprised of two semi-spherical casings, keyboard, terminal plate, voltage variation plate, light holder and LED. Wherein, said semi-spherical casing 5 (55) is provided on its inner surface multiple caulking grooves 51 (551) in identical size and equal spacing; and on its outer surface, multiple longitudinally arranged retaining rings 52 (522) in equal spacing. Two matching holes 512, 5512 pass through the ring 52 (522) and caulking groove 51 (551). A tapered channel track is provided in the matching hole 512 (5512) to accommodate insertion by two wings from the terminal plate 7. Both said semi-spherical casings 5, 55 are each connected at its front end a semi-circular gland 53(553) to form a full circle enclosure when both semi-spherical casings are joined. The keyboard 6 relates to a strip circuit board. Corresponding to the ring 52 (522), pairs of positioning holes 61, 62 respectively for positive and negative electrodes are provided on the keyboard 6. At one end of the keyboard away from the gland 53 (553), two DC pins 63, 633 respectively for positive and negative electrodes are provided to connect the voltage variation plate 8. The terminal plate 7 has at its lower end a longitudinal insertion flat 71 and extends at its both sides two wings 72, 73. The surface of each wing 72 (73) is counter tapered to facilitate sliding into its corresponding tapered channel beneath the casings 5,55. The terminal plate 7 has at its upper end a sleeve 76 aligned in the matching hole 512 (5512). The voltage variation plate 8 has at its one end two plug sockets

81, 82, and has on both of its sides resistors, capacity regulation and voltage transformation devices. The light holder 9 relates to a plastic casing and has one end connected to a copper cap 91. Multiple of mortises 92 are provided at equal spacing in the inner peripheral of the holder 9 to snap onto the closed semi-spherical casings 5, 55. Two relatively retaining frames 93, 95 are provided in the holder 9 to hold the voltage variation plate 8 in position by engaging two slots 931, 951 for incorporating the terminal plate 7, the keyboard 6, the semi-spherical casings 5, 55 and the inserted diodes into an integrated assembly.

In use, when the terminal plate is inserted into the positioning holes 61, 62 in the keyboard 6, a longitudinal plane is formed for positive and negative current. Counter tapered wings 72, 73 from the terminal plate 7 are used for the inner edge of each semi-spherical casing to align to its corresponding tapered channel track for easy insertion to incorporate to the keyboard 6. Furthermore, the sleeve 76 on the terminal plate 7 aligns to the matching hole 5512 by the channel track to fast penetrate through the semi-spherical casing 55. The voltage variation plate 8 is vertically held in position by said two retaining frames. Multiple of tenon A provided on the circumference of the joined semi-spherical casings on the side without the glands 53 553 are used to couple to their corresponding mortises 92 to form an integrated part. Two pins 11, 12 of a diode 1 then are inserted through the semi-spherical casing 5 (55) to the terminal plate 7, and connected in parallel also with the keyboard 6 and the voltage variation plate 8 to provide excellent conductivity. Wherein, the tapered channel track functions as a buffer for the wings to eliminate the pressure downward by the diode 1, so that the sleeve 76 may firmly secure the pins 11, 12.

In addition to offering convenient replacement of the bulb, the present invention may add more colorful living space in adaptation to the environment by changing the combination of the colors of the diodes as desired.

I claim:

1. A convenient replacement composite power saving environmental bulb comprised of two semi-spherical casings, a keyboard, a terminal plate, a voltage variation plate and a light holder characterized in that;

semi-spherical casing, having on its inner circumference caulking groove, corresponding rings longitudinally arranged at equal spacing on its outer surface;

each ring having two matching holes to connect the caulking groove, a pair of tapered channel track to receive both wings from the terminal plate and a gland provided at the front of said semi-spherical casing;

a keyboard, relating to a strip circuit board having electrode-positioning holes corresponding to the ring, and having two DC pins at the end close to the holder to connect the voltage variation plate;

a terminal plate, having at its lower end a longitudinal insertion flat, at its middle two wings, at its upper end a sleeve aligned to the matching hole in the semi-spherical casing and said wings each having counter tapered groove to engage the tapered channel track in the matching hole;

a voltage variation plate, having its one end two plug sockets and on its surface resistors, capacity regulation and voltage transformation devices; and a light holder, relating to a plastic casing joined to a copper cap, having multiple mortises at equal spacing provided in its inner circumference to receive corresponding tenon provided on the semi-spherical casings; and two retaining frames inside the holder to hold the voltage variation plate in position to become an integrated structure together with multiple diodes each having its two pins inserted into the sleeve to the terminal plate, both semi-spherical casings, and the voltage variation plate in parallel for providing excellent conductivity.

2. A convenient replacement composite power saving environmental bulb as claimed in claim 1, wherein, two matching holes are provided in each of the rings longitudinally arranged at equal spacing on the outer surface of each of said two semi-spherical casings to allow fast insertion into position by the sleeve from the terminal plate inserted into the keyboard.

* * * * *